United States Patent [19]

Bell

[11] 3,972,284

[45] Aug. 3, 1976

[54] NEEDLE POINT PRINTING APPARATUS

[76] Inventor: Dale J. Bell, 3016 Central St., Evanston, Ill. 60201

[22] Filed: Mar. 5, 1974

[21] Appl. No.: 448,382

[52] U.S. Cl. ..... 101/327; 101/368; 101/407 BP; 427/176

[51] Int. Cl.[2] ..... B41F 31/00

[58] Field of Search ..... 101/327, 368, 407 Bp, 101/407 R, 172, 126, 193, 41–44, 386, 316; 117/15; 118/33, 234; 427/171–176

[56] References Cited

UNITED STATES PATENTS

| | | | |
|---|---|---|---|
| 1,845,553 | 2/1932 | Partiot | 101/172 |
| 3,221,649 | 12/1965 | Weiss | 101/126 |
| 3,415,185 | 12/1968 | Paterson et al. | 101/327 |
| 3,434,456 | 3/1969 | Geating | 101/172 |
| 3,503,232 | 3/1970 | Farrer et al. | 101/172 X |
| 3,701,315 | 10/1972 | Maund | 101/172 X |
| 3,763,776 | 10/1973 | Jaffon | 101/126 |
| 3,819,445 | 6/1974 | Devries | 427/288 X |

*Primary Examiner*—Edgar S. Burr
*Assistant Examiner*—Edward M. Coven
*Attorney, Agent, or Firm*—Bruce K. Thomas

[57] ABSTRACT

Painted color guide or coded areas for use in sewing, stitching or darning needle-point work are applied to needle-pont canvas by sequential stamping or rolling with shaped soft matt carriers while the canvas is supported upon and bi-axially oriented with a matching support grating. In one embodiment hand-operated apparatus is disclosed whereby the matt or pinned carrier and the grating are pivotally oriented one to the other for interengagement upon the canvas. In another embodiment the grating is in the form of at least one continuous belt over the top of which the canvas is moved against orienting pins for sequential application of a plurality of colored areas. In both embodiments the finished product is characterized by the accuracy and speed in which the color coded areas, making up the total design, are applied.

16 Claims, 21 Drawing Figures

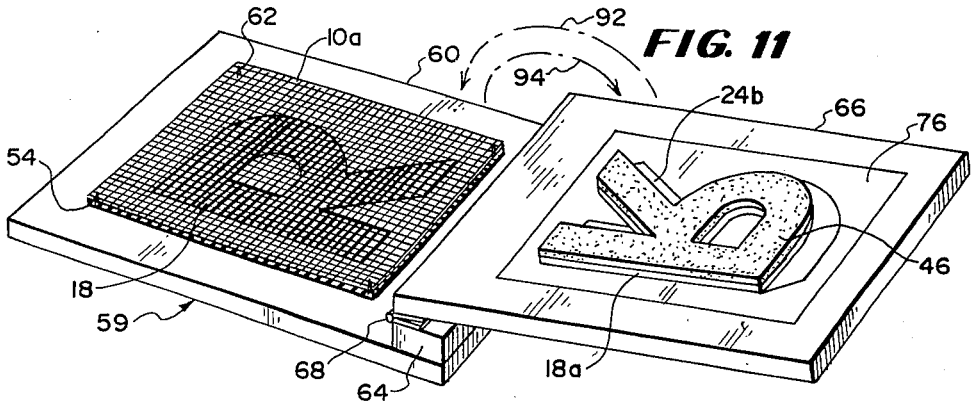
FIG. 11
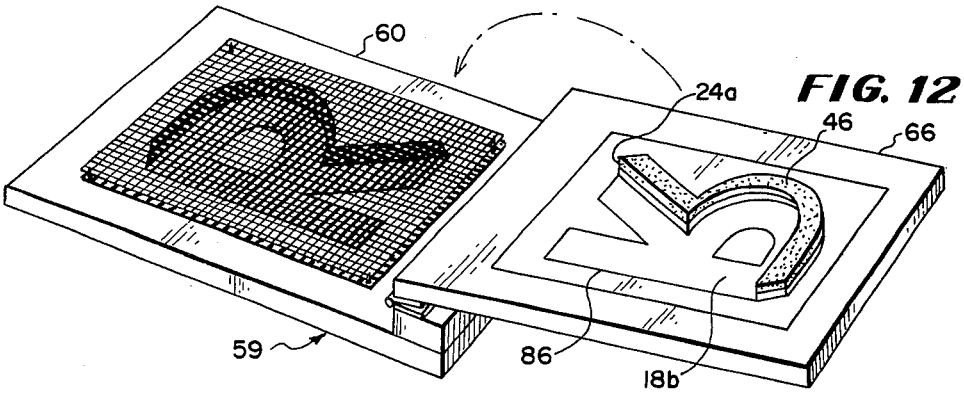
FIG. 12
FIG. 13
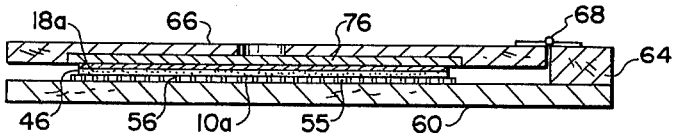
FIG. 14
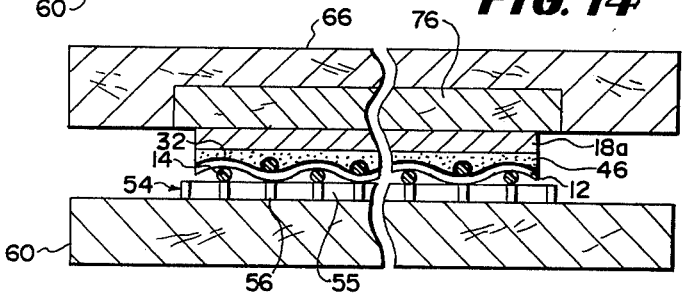
FIG. 15
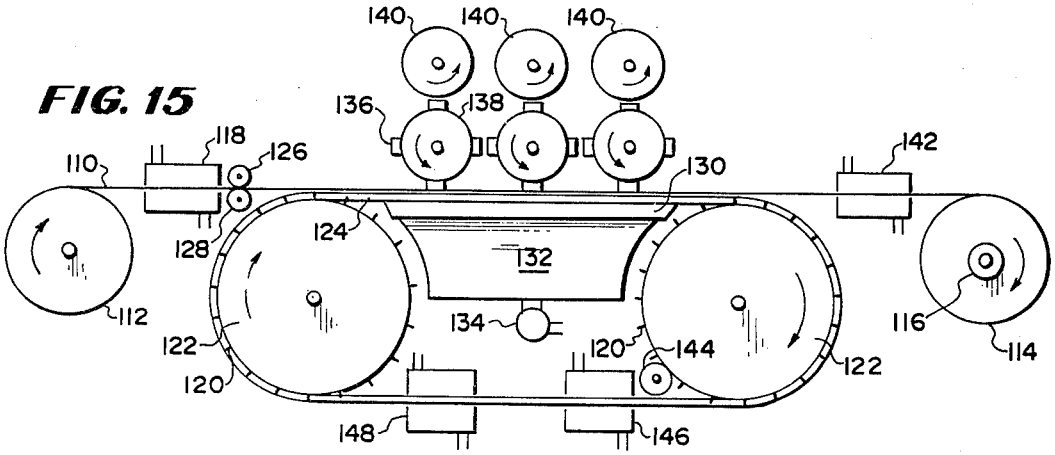

NEEDLE POINT PRINTING APPARATUS

BACKGROUND OF THE INVENTION

A large portion of the printing art relates to the formation of a painted image on a plane surface such as paper and the like as it is held against a flat or curved backing. The art has employed resilient rubber surfaces to paint a design or letters on irregular surfaces such as corrugated cardboard as illustrated by the Harbison U.S. Pat. No. 2,014,043 and the Jones U.S. Pat. No. 2,893,320. In both of these patents a soft rubber printing surface is used to print a complete design upon an irregular receiving surface, such as corrugated paper, calicoes, cotton cloth and cardboard. Block printing machines have been employed in the past to print soft fabrics and other materials as illustrated by Herr U.S. Pat. No. 2,735,653. Animations are printing using resilient foamed plastic blocks, in Bubert U.S. Pat. No. 2,684,012 but the images are placed on a solid or firm planar surface.

Heretofore, needle-point printing, that is, the formation of a colorcode image of a design on needle-point canvas has been accomplished by tedious, time consuming and expensive hand painting. Each square or piece of needle-point is laboriously completed by hand. The costs of the completed canvases are high as a result and consequently, this art or hobby is not open to everyone. Hot stamping and silk screening methods are also used. In the former process only three or four copies can be made from an original as the image becomes progressively more faint, the latter process is expensive and there is a problem of excess paint spoiling the design. Regardless of cost, these processes do not always produce a sharp line of demarcation between the different colors along diagonals or along the edges or cover the threads well. Consequently, although the completed canvases are expensive they do not always have sales appeal. Another drawback is that the canvas is not oriented or squared during the application of the design and the finished design after sewing of the proper colors of yarn thereon becomes distorted when applied and stretched as an upholstery cover or other display.

SUMMARY OF THE INVENTION

In accordance with this invention these and other difficulties are avoided by supporting and orienting the needle-point canvas on a matching grate during the application of the paint thereto by means of a platen or block having as its printing surface a thin layer of expanded absorbent plastic. After experimenting with a number of materials, such as rubber, felt, steel plates, cloth and the like in various thicknesses and having different textures, while supporting the canvas on a planar surface, it was found that the paint did not cover the intended areas uniformly and the finished product was entirely unsatisfactory. Clean, sharp lines between the colors of the design and along the borders are essential to the successful production of saleable needle-point patterns. The paint did not properly cover the junctures of over-lapping strands, the edges were irregular and the margins between colors were blurred without the fault of the accuracy of cut edge of each part of the design block. By further experimenting it was found that clean, uniform patterns with sharp edges and margins could be applied by block printing successive parts of the design on the needle-point canvas, if the canvas was supported under each strand and there was no support under the voids or square holes between the strands.

By these means any excess paint did not run to the underside of the strands, the actual application time was reduced and the overall work and time to produce a good sharp array of images for the needle-point maker to follow was reduced to a fraction of the time required for hand painting. Any excess paint which did flow through the voids in the grating did not affect the accuracy of the print and was easily removed or drained away.

Accordingly, an object of this invention is to provide a process for the manufacture of needle-point design pieces that is rapid and inexpensive and greatly improves the appearance and utility of the end product.

Another object of this invention is to provide the apparatus and means by which needle-point design kits can be manufactured on an intermittent or continuous basis.

These and other objects of this invention will become apparent or be set forth as the description proceeds.

DESCRIPTION OF THE DRAWINGS:

Illustrative embodiments of the invention are shown in the drawings in which:

FIG. 3 is a cross-sectional view taken along line 3—3 of FIG. 2 while

FIG. 11 is a view of the apparatus of FIG. 10 after an impression of one part of the design has been made;

FIG. 12 is a perspective view of the apparatus of FIGS. 10 and 11 with the next design partly in place for printing;

FIG. 13 is an end view of the apparatus of FIG. 11 in closed position;

FIG. 14 is an enlarged cross-sectional view of one part of the apparatus showing in detail the cooperation of the parts;

FIG. 15 is a schematic view of apparatus for carrying out the process on a continuous basis;

DESCRIPTION OF THE PREFERRED EMBODIMENTS

Figure 1:
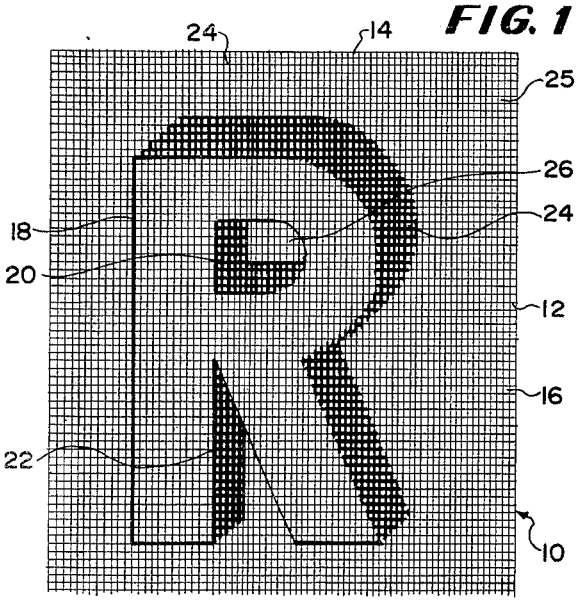
FIG. 1 is a plan view of a piece of needle-point bearing an illustrated design having four parts of different shapes and colors.

Referring to FIG. 1, there is shown a piece of needlework canvas 10 comprising the woven strands 12 extending in one direction and the strands 14 extending at right angles thereto in a typical over-and-under weave. The intersection of a pair of adjacent strands in one direction with a pair of adjacent strands extending in the other direction defines an essentially square opening 16. Needlework canvas is furnished in a number of weights and grid sizes. These are designated No. 10, 12 and 14 Penelopy and No. 10, 12 and 14 Mono for example, meaning the number of strands or holes per square inch. Thus, the size of the strands and the number of strands governs the weight of needle-point.

The needle-point canvas 10 in FIG. 1 is shown bearing the letter "R" painted thereon as an illustrative design. The R is shown as a three-dimensional figure having the planar portion 18, the inner shaded areas 20 and 22 and the outer shaded edge portion 24. These portions are painted in different colors to accentuate and delineate the design so that the seamstress or sewer can apply the same color of yarn to these designated areas in order to reproduce in finished needle-point the design shown. The unpainted areas, such as the outer area 24 and the inner area 26 can be for background and left to the choice of the seamstress or recommended or included in a kit. Alternately, the areas 25 and 26 can also be painted to coordinate the design and its background for the seamstress.

Figure 2:
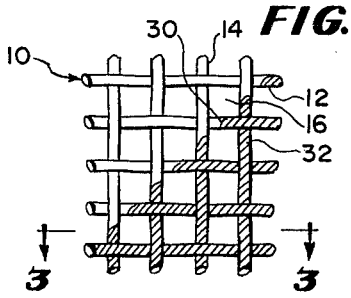
FIG. 2 is a fragmentary view greatly enlarged of a portion of the canvas showing the painted surfaces of the strands.

FIG. 2 is an enlarged fragmentary view of the needle-point piece 10 of FIG. 1, which can represent any of the painted areas and the border 30 of the paint 32 thereon. FIG. 2 shows that each of the strands 12 and 14 is covered on its top surface and sides by the paint 32 in accordance with this invention. In other words, all of the exposed areas of the strands on one side of the canvas are covered uniformly with the paint 32 in the desired areas. By covering the sides of all of the strands the appearance is that of a strand being that color to the very core, in whatever area, thus adding to the sales appeal.

Figure 3:
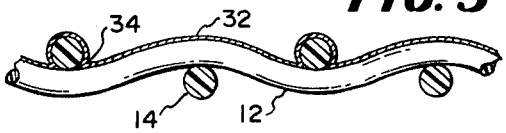
Figure 3A:
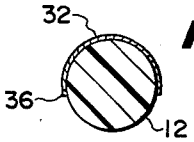
FIG. 3*a* is a cross-section of a single strand.

In FIG. 3, it is seen that the paint layer or colored portions 32 of the strands extends into the corners 34 so that uniform coloring is attained. In FIG. 3*a*, a cross-section of a strand, greatly enlarged, shows how the paint layer 32 extends over the sides and contour of the strand 12 and the outermost edge 36 of the paint is even with or below the horizontal outer line or diameter of the strand. FIG. 3*a* can also represent the manner in which the paint covers a substantial portion of the surface and contour of a strand 14. Accordingly, the strands are uniformly painted where intended on one side of the needle-point canvas and sharp lines of demarcation 30 at the edges are possible by the method and apparatus of this invention.

Figure 4:
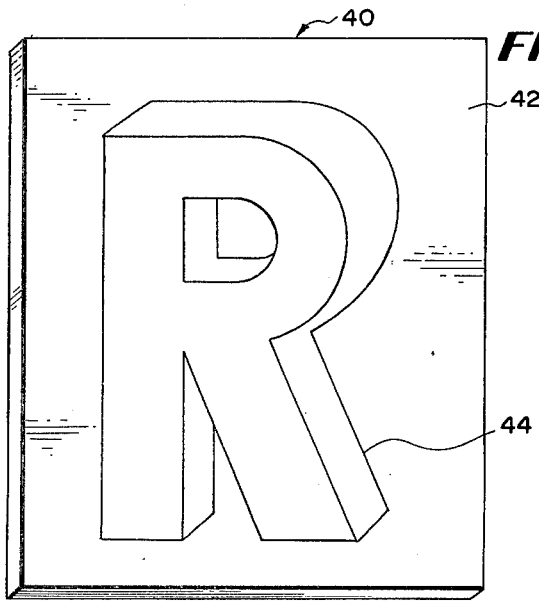
FIG. 4 is a plan view of the design drawn on a stiff backing sheet.

In order to attain this result the design parts of the R must first be formed. This is illustrated in FIG. 4 wherein the plate 40 having the planar surface 42 carries the drawn design 44 of the R. The plate 40 can be any relative rigid material such as fiber board, cardboard, plastic or metal. The flat surface 42 can be treated with a water-proofing agent and preferably the entire composition of the plate is impregnated with suitable agents such as silicones to render same resistant to moisture unless same is constructed of inherently moisture or solvent resistant material such as a metal.

The outline 44 of the "R" design is drawn by any suitable means on the plate 40 in exactly the desired configuration to conform with the parts 18, 20, 22 and 24 of the same design in FIG. 1. These parts are then cut out along the outline 44 to form the desired number of basic pattern parts of the design as shown in the exploded view 4*a*. For identification these parts can be cut by machine or by hand as desired.

Figure 6:
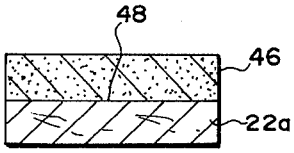
FIG. 6 is a cross-sectional view taken along the lines 6—6 of one of the parts of FIG. 5.
Figure 7:
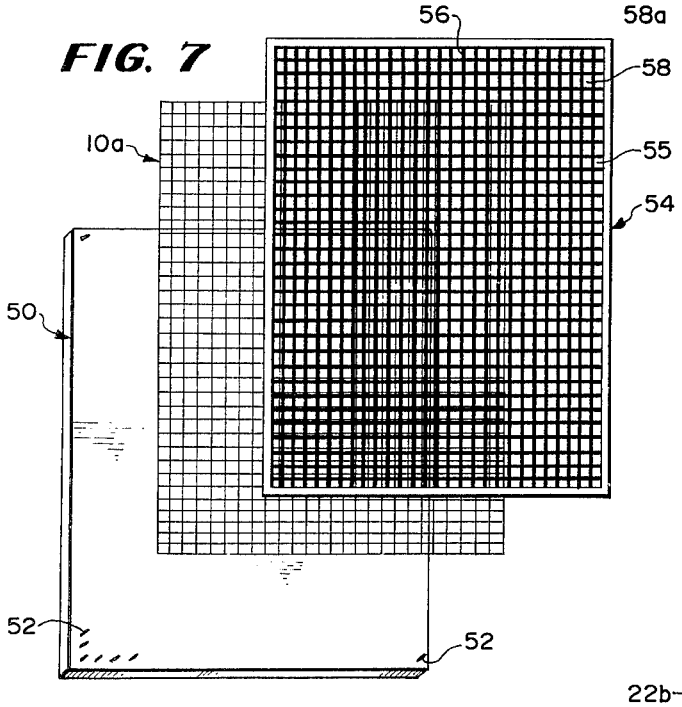
FIG. 7 is an exploded view of an orienting plate, a piece of needle-point and the support grating.

These parts are next reversed and a thin layer of expanded plastic material 46 is applied to the back sides by means of a suitable adhesive such as rubber cement. This layer is about 1/16 to ⅛ inch in thickness and the edges are trimmed so that they conform with the edge outline of printing base parts 18*a*–24*a*. FIG. 6 shows the juncture 48 of the glue line between the reverse side of the stiff backing or printing base 22*a* and the layer of porous soft plastic 46. Alternately, the layer of expanded plastic 46 can be applied over the back side of the plate 40 and the plate and plastic cut out simultaneously.

The next step in the operation is to steam and shape the piece of unprinted needle-point canvas 10*a* to be used to make the completed product 10. This step may or may not be necessary depending on the condition of the canvas. Being relatively stiff material, the canvas may be damaged or deformed in storage or transit and thus not perfectly square, that is the various strands 12 and 14 may not be exactly perpendicular to each other. Steaming and slight stretching followed by air drying takes out any discrepancies in the canvas 10*a* and produces a uniform network of strands 12 and 14 and spaces 16 across the selected piece. Two or more designs can be placed together to fill the full width of a given canvas, then cut to separate after printing. The canvas 10*a* is also cut to size along the outer edges so that it is suitable for the intended end use i.e., a pin cushion or a wall tapestry or furniture covering. The canvas is generally larger along each of its dimensions than the area to be covered by it after the colored yarn is applied. As an aid in orienting the canvas, with or without steaming and drying, the peg or pin board 50 is used. This board 50 is rigid and substantially planar and can be formed of any stiff material such as plywood, pressed board, plastic, etc., like that used for the backing plate 40 for the printing pieces 18*a*–24*a*.

A plurality of spaced upright pegs or pins 52 is provided projecting from one side of the board 50. Preferably, the board 50 is about the size of the prepared needle point piece 10 and the pegs 52 are arranged in a pattern conforming to the spacing and number of spaces or holes 16 in the needle-point. There need not be one pin 52 for each space 16. Thus, each corner of the board 50 can be provided by a pin 52 while one corner or other portion of the board may have an array of pins in one area that are spaced to orient the needle-point canvas along two axes. When the steamed canvas is placed on the orienting board 50 with the pins in the proper spaces, the canvas is squared and allowed to dry. Air blowing or the application of a partial vacuum can be used to speed up the process.

The rigid lattice or supporting grid member 54 is then placed over the canvas. This member is provided with a series of spaced ribs 55 extending in parallel and equally spaced relationship across one axis of the grid and the ribs 56 extending in the same parallel and spaced relationship across the second axis and perpendicular to the first axis. This provides a checkerboard of equal size square apertures 58 therebetween. The ribs 55-56 conform to the strands 12 and 14 of the needle-point canvas while the apertures 58 conform to the spaces 16.

Figure 8:
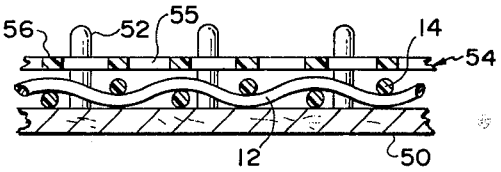
FIG. 8 is an enlarged fragmentary cross-sectional view of the parts of FIG. 7 in assembled condition.

Thus, supporting grid 54 upon being placed over the canvas 10 on the support board 50 conforms thereto and the pins extend through the apertures 58. This is shown in FIG. 8. The pins 52 are about the same size as the apertures 58 of the grid 54 and the spaces 16 of the canvas 10. The pins can be, as illustrated, of lesser size than the apertures and spaces and the orientation of a plurality of the pins, where necessary along with the grid placed thereover flattens and straightens the canvas. The grid 54 can be present during the steaming and drying operation.

Figure 5:
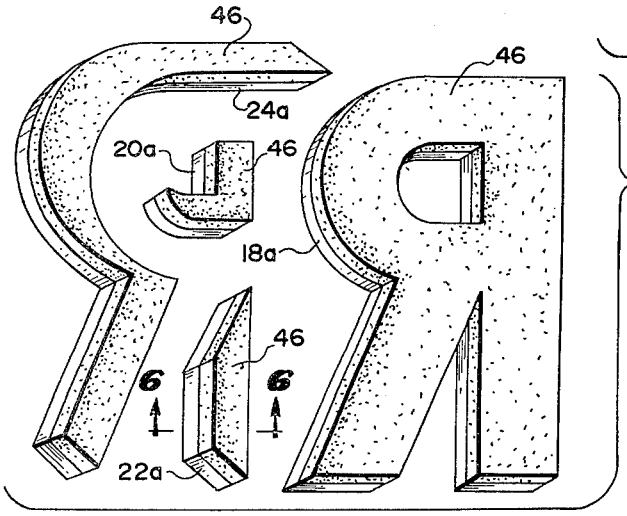
FIG. 5 is an exploded view of the back side of the design pieces of FIG. 4 after a thin layer of foamed plastic as the printing surface has been applied thereto.

The grid 54 and the canvas 10*a* are removed in this oriented condition from the orienting board 50 in condition for printing, using the pattern parts of FIG. 5 in sequence.

Figure 9:
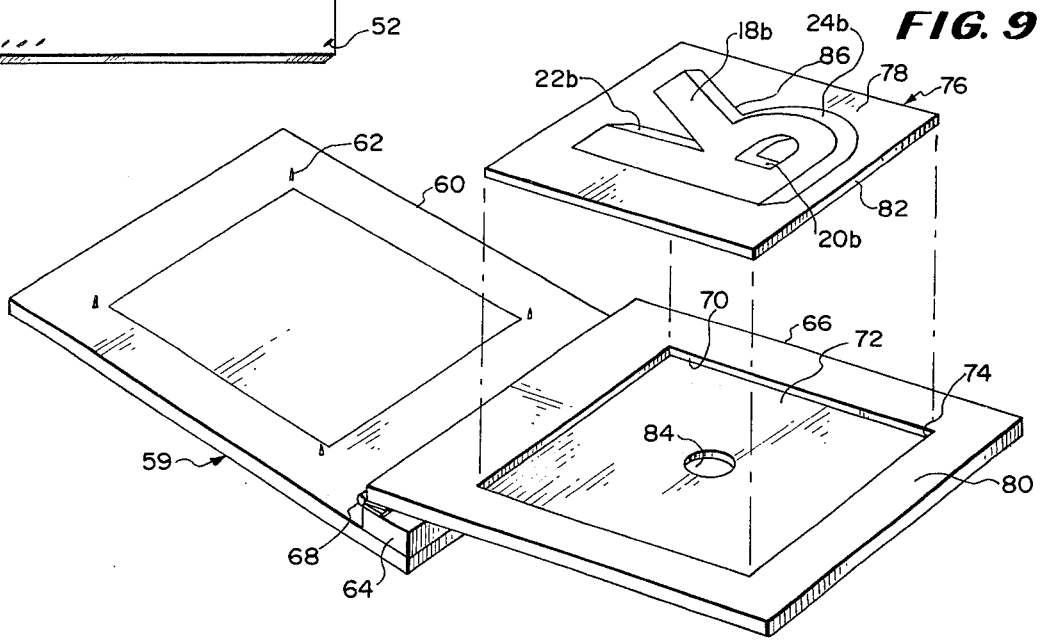
FIG. 9 is a perspective view of one form of apparatus with the printing plate shown in relation to one part.

A crude but effective hand printing press 59 is illustrated in FIG. 9 for this purpose. The press 59 comprises the bottom platen or base plate 60 having the four spaced upright corner pins 62 oriented so as to engage a corner aperture 58 of the grid member 54, when the latter is laid thereover with the canvas on the top side. This bottom platen has the vertical spacer plate 64 fastened along one edge and the printing plate holder 66 is hinged to the inner edge thereof by means of the piano-type hinge 68. The printing plate holder 66 is provided with the square or rectangular recess 70 having a planar bottom supporting wall 72.

As before stated the printed canvas 10 is larger than necessary to cover a given area as upholstery or the like, to allow for an edge to block the piece when completely stitched. Thus, the grid 54 and the dimensions of the pin placement on the bottom platen are also correspondingly larger. As will be described in more detail, the printing plate holder 66 can be pivoted about the hings 68, with the platen 60 resting on a supporting surface such as a table top or work bench, so that it is positioned over the platen 60 with the recess 70 above and oriented with the area defined by the pins 62. The vertical depth of the spacer plate 64 is such that in this position the printing plate holder 66 and platen 60 are in opposed spaced and parallel relationship. In this position the pins 62 are oriented in the proximity of the corners 74 of the recess 70.

FIG. 9 also shows the guide printing plate 76 which is sized and shaped so as to fit within the recess 70 with its upper flat surface 78 substantially co-planar with the flat surface 80 of the plate holder 66. The plate 76 is made of rigid material, like the platen 60, and the plate holder 66 which may be of the same material as the plate 40. Actually, the plate holder 66 can have a laminate structure and the piece cut out to make the recess 70 in one layer of the plate holder 66 can be used as the printing plate as long as it fits back in the recess in a fixed relationship. For this purpose the outer peripheral edges 82 of the printing plate can be provided with a thin gasket of rubber or plastic so that the printing plate can be placed in the recess 70 in a fairly tight relationship and remain in proper relationship with the plate holder 66 as it is hinged over upon the platen 60. The hole 84 in the bottom of the recess 70 can be provided through which one can press the printing plate back out of the recess when a change in design is desired.

Figure 4A:
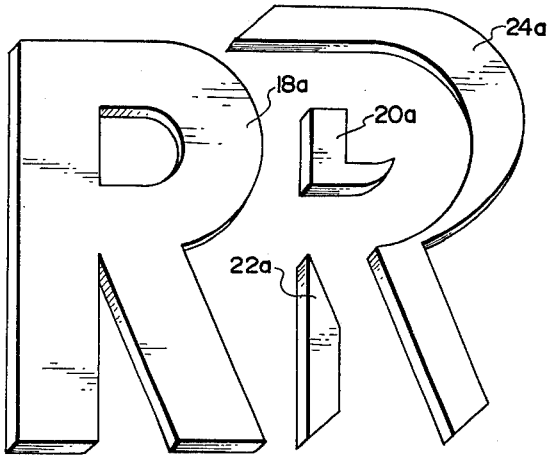
FIG. 4*a* is a segmented view of the cut out parts of FIG. 4.

The printing plate bears the guide outline 86 of the design of the R in reverse orientation to show the areas 18*b*, 20*b*, 22*b* and 24*b* which correspond to the printing plates backings 18*a*, 20*a*, 22*a* and 24*a* of FIGS. 4*a* and 5 already described.

Figure 10:
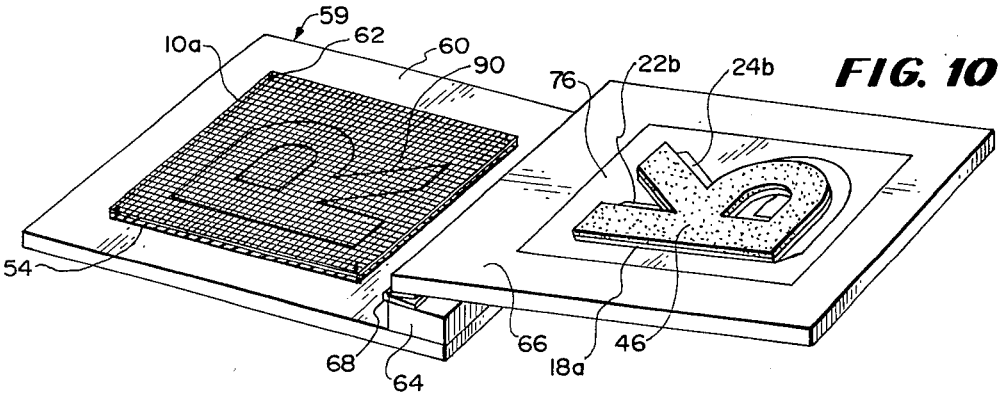
FIG. 10 is a perspective view of the apparatus of FIG. 9 readied for use in forming one part of the design of the printed needle-point in accordance with this invention.

Either before or after the printing plate 76 is placed in the recess 70 of the plate holder 66 one part of the design is placed over the corresponding guide outline. This is illustrated in FIG. 10 wherein the main part of the R, namely the portion 18*a*, with its foamed plastic surface 46 on the upper side is placed upon the corresponding guide area 18*b* of the printing plate 76. The remaining areas of the guide 86 are uncovered. The oriented grid 54 and unprinted canvas 10*a* are placed on the platen 60 with the pins 62 serving to hold the assembly in place with the canvas 10*a* on top. This places the intended area for the printing of the R as indicated in faint lines at 90 in FIG. 10 in the proper part of the canvas.

A suitable paint of the desired color is next applied to the foamed plastic printing surface 46 of the design part 18*a*. This can be done by means of a paint roller, or brushing. Any type of paint composition can be used that is relatively slow drying and suitable for the intended transfer purpose. Preferably, a water base or latex type paint is used since this type of composition is water soluble until set and readily removed by water washing of the parts to prevent build-up of paint or to facilitate cleaning the apparatus after use. Oil base paints may be used. Preferably the paints used are of permanent and water-proof nature. Acrylic type of paints are suitable since they are also slightly elastic.

The press 59 is then folded in the direction of arrow 92 (FIG. 11) so that the freshly painted foamed plastic surface 40 of the part 18*a* is pressed evenly upon the canvas 10*a*. This step forms the first design portion 18 on the canvas in the desired color as shown in FIG. 11. The plate holder 66 is then pivoted back in the direction of the arrow 94.

If one complete design of only one finished needle point canvas 10 is to be prepared, the succeeding parts 20*a*, 22*a* or 24*a* are affixed individually to their designated areas 20*b* etc., paint is applied and the foregoing printing process repeated as before until all of the design parts have been used to paint the three-dimensional R on the canvas 10. Alternately and for faster work where a number of canvases 10 are to be prepared with the same design, a number of canvases can be printed as illustrated in FIGS. 10 and 11 and set aside to dry. Then these can each be replaced on the platen 60 as the next desired part of the design, such as the part 24*a* (FIG. 12) is placed over its corresponding area 24*b* on the printing plate 76, and the printing step completed. Successive parts of the design are thereafter applied until all of the canvas pieces are processed.

FIGS. 13 and 14 show the relationship of the parts during the printing process and how the grid 54 supports each of the strands 12 and 14 of the canvas in both directions so that the foamed plastic layer 46 presses down upon and yields to conform with the contour of the strands and thus apply paint to each strand in the manner shown in FIG. 3*a*.

Referring to FIG. 15 there is shown in schematic form an apparatus for conducting the steps of the method of this invention or a continuous basis. The apparatus in general comprises means for conveying an elongated strip of needle-point canvas through the machine into contact with a steaming zone and upon a continuous belt comprising a supporting grid. While so supported and oriented upon the grid the top side of the canvas is contacted by one or more printing wheels carrying the soft printing pads of the desired design. The pads receive a continuous supply of paint of the desired color from applicators thereabove. A support grid is applied under the grid belt and a partial vacuum is applied to the support grid. The canvas then passes through a drying chamber to a take-up roll. Means are provided for cleaning and drying the continuous grid as it passes on the return cycle to the support grid.

In FIG. 15 the canvas strip 110 is fed from the feed spool 112 to the take-up spool 114 by any suitable drive motor represented at 116. The canvas strip 110 passes through the steam chamber 118 and upon the orienting pins 120 carried by the pair of large spaced cylindrical drums 122 around which is carried the continuous belt 124 of supporting grid. The pair of guide rollers 126 and 128 are angled slightly to the longitudinal axis of the strip 110 and the tension between the spools 112 and 114 applies a slight longitudinal stretching. The pins 120 and the holes in the grid 124 are oriented so that each pin protrudes through a corresponding hole in the grid and extends therethrough about the depth of the strands of the canvas strip 110. The grid 124 passes over the support grid 130 which has the chamber 132 there-beneath to catch any excess paint. A light vacuum or air draft is applied to the chamber 132 by means of the motor driven exhaust fan 134.

Immediately above the support grid 130 and spaced therefrom sufficiently to allow the passage of the canvas strip and the continuous grid 124 are the printing shoes 136 carried by the drums 138. The printing shoes 136 carry the design parts as heretofore described. Above the printing shoes and in rolling contact therewith are the paint drums 140 for each different color of the design. After the application of the design the canvas passes through the air drier chamber 142 and onto the take-up spool 114.

Since the pins 120 and the continuous grid 124 may gradually pick up paint they are cleaned before return to contact with the canvas. Thus, the cleaner brush roller 144 contacts the pins at one point on the periphery of the drum 122, as indicated, and the continuous grid 124 passes through the cleaning chamber 146 and the drier chamber 148 on the return leg.

Any problem of paint oozing to the ends of relatively long portions of the pattern are eliminated by rearrangement of the printing shoes 136 so that they print one line of canvas and skip one. Then the next roller printing shoe would print the alternate space and skip one. A system whereby the printing shoes print two lines of canvas and skip two print one line of canvas and skip two is also contemplated. Other spacing systems can be used.

This eliminates any build up of paint and the problem of paint passing through the canvas and causing overflow at the edges between colors which would blur the line of demarcation between colors. The aligning pins 120 on the rollers 122 are then arranged in rows running across the surfaces of the rollers and the alternate spaces between the rows are printed. To complete the design the roll of canvas on the roller 114 is again passed through a printer oriented to complete the design by printing on the unprinted portions thereof. The problem of any paint oozing from thread to thread, especially for canvas of finer weave, is thus eliminated. The process can also be arranged so that one transverse thread and the over-lapping longitudinal threads are printed at a time, with the alternate transverse threads left unpainted, followed by a succeeding pass wherein the unpainted strands are painted.

Figure 16:
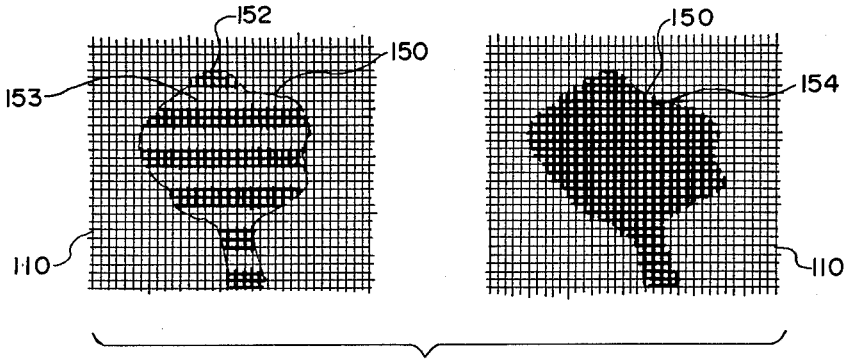
FIG. 16 is a composite view showing the printing of successive portions of a canvas.

This is illustrated in FIG. 16 wherein the design of a tree 150 is placed on the canvas 110 in a first pass by printing the transverse section 152 leaving the spaces 153 without paint and then by means of a second printer or running the canvas through the same printer offset sufficiently so the sections 152 are painted as illustrated by the painted sections 154.

The canvas becomes more flexible and tends to stretch on being wetted with paint, accordingly it is important that for more intricate designs the canvas be held in alignment all along the area under the printer 136. One method of accomplishing this would be to provide an adhesive surface on the grid 124 along the outer edges. Alternately the grid can be provided with pins along the edges which engage the canvas and hold it in place regardless of any tendency to stretch.

Figure 17:
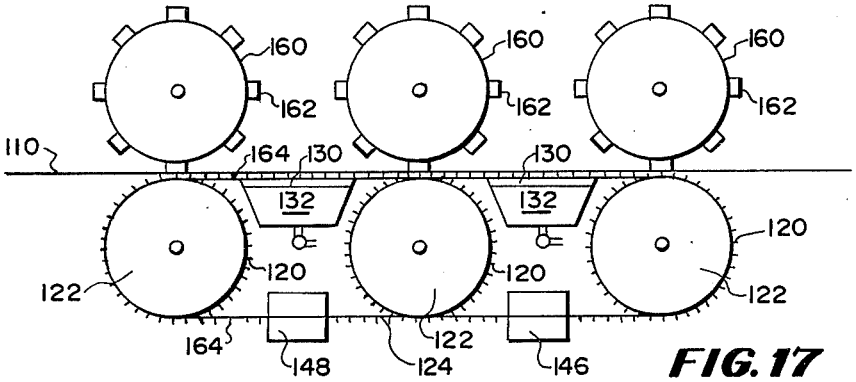
FIG. 17 is a schematic view of another apparatus for carrying out the process.

FIG. 17 illustrates this embodiment diagrammatically wherein the machine has the series of three roller printers 160 having resilient printing shoes 162, each shaped to form a part of a design and each depositing paint of a different color to the canvas 110. Paint is supplied from within the drums 160 to each of the shoes in this embodiment. The arrangement of supporting grids 130 and vacuum chambers 132 is alternated between the rollers 122 and each roller has a series of aligning pegs or pins 120 on its periphery. These pins may be spaced in any arrangement, to conform to the holes in the canvas. They may be located only along the edges or placed in rows across the entire surface of the drums or rollers. The cleaner 146 and the drier 148 are likewise spaced between the rollers 120. Instead of having the printers 160 roll or rotate, a suitable mechanism can be provided to raise and lower each roller to and from its printing position upon the grid supported canvas. Thus, an individual roller can lower to print, then be raised and rotated to bring the next shoe 162 into position and then lowered to print.

In this embodiment the grid 110 is altered to include the groups of pins 164 which extend along the edges of the grid 124 outwardly at the edges of the canvas. These pins are placed so as not to interfere with the pins 120 which are on the rollers 122. The bottom or inside surface of the grid 124 is devoid of pins and slides over the supporting grids without interference as any excess paint is withdrawn.

Figure 18:
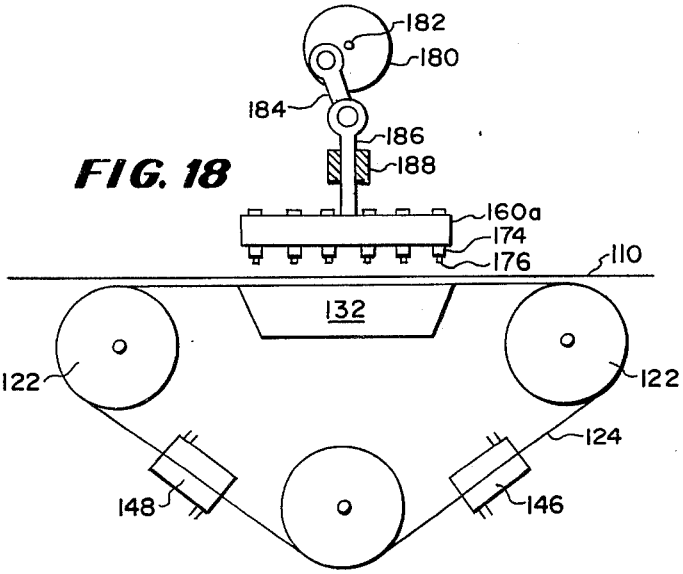
FIG. 18 is a schematic view of an apparatus to carry out the process intermittently.

FIG. 18 is merely illustrative of another arrangement wherein the rollers 122 are arranged for a shorter span and a modified vertically oscillating printer 160 a is shown with the printers 174 arranged in cartridges and having their shaped printing surfaces 176 of soft plastic extending beyond the lower surface of the printer 160*a*. The cartridges 174 hold a supply of liquid ink or paint of various colors as desired and print spaced patterns across the canvas 110. Any pattern of printing cartridges can be set up in the printer 160*a* and any means can be used to affix the cartridges therein. Thus the cartridges can be held with magnets or the like. The modified printer 160*a* is provided with means to cause it to oscillate on a vertical axis in timed sequence to and from a printing position. Such means are illustrated by the drive wheel 180 rotating on the shaft 182 and connected by means of the connecting rod 184 to the carrier rod 186. The housing 188 provides vertical guidance and alignment for the carrier 186. The other parts are the same as in FIG. 17. The grid 124, upon which the canvas rests is moved intermittently between each printing stroke.

Figure 19:
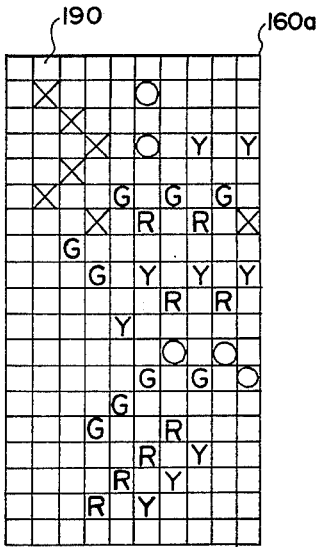
FIG. 19 is a bottom plan view of the printing head shown in FIG. 17.

FIG. 19 illustrates the under surface of the printer 160*a* with the numerous compartments 190 therein into which a printing cartridge can be inserted. The symbols X, O, R, G and Y are used to illustrate various cartridges therein each printing in a different color e.t. all X symbols can represent blue, the O symbols can represent lavender, the R red, G green and Y yellow. Each of the compartments is oriented over the canvas so that the shoe 176 prints upon the intersection of the strands of the canvas with no two or more cartridges of different colors being adjacent, except on the diagonals. Instead of using cartridges each compartment 190 can represent a paint reservoir with a printing shoe 176 at the bottom. After the completion of one part of the design as illustrated in FIG. 19, the arrangement of cartridges or the paint in the reservoirs is changed to print on the desired unprinted cross-overs of the canvas to complete the design in two steps. More complicated designs may require additional printing cycles in the same or successive machines. Cartridges or reservoirs of the same color can be adjacent along either axis of the printer.

The outer printing surface of the soft plastic 46 (FIG. 5) can be contoured to conform with the surface of the canvas 10. This can be done by molding these parts against a surface of canvas. Likewise, the printing surfaces 170 of the printing shoes 136 or the printing shoes 162 can be shaped to conform with the canvas surface.

All types of needle-point canvas can be printed using the method and devices of this invention. Petti point and rhyza canvas can also be accurately printed. The process of this invention is particularly useful for needle-point and rhyza canvas or so-called rug-type canvas.

The printing rollers 138, 160 need not be round and can have triangular or other cross-sectional configurations. Thus, if the rollers are triangular they would present three flat printing surfaces to the canvas.

Various modifications can be applied to the method of this invention and included in the apparatus. Instead of using the pegs 52 to hold the canvas and grid support upon the platen 60, small strips of pressure sensitive tape, placed at the edges or across the corners can be used. The area below the canvas and grid support in the platen 60 can be cut away or perforated so that any excess paint can be drawn off by a vacuum or blown through by a controlled blast of air from the canvas side of the assembly. This prevents any build-up of paint on the grid which may interfere with accurate copying of a design. The support grid can be formed of plastic or metal and the grid network of the ribs therein should conform quite exactly with the mesh of the canvas for best results.

For some applications the canvas and grid support can be held in proper alignment on the platen 60 by means of a thin layer of rubber cement that is waterproof and not affected by the paint. Preferably a non-drying cement or the non-permanent kinds of glue compositions are used so that they can be readily removed and re-applied in a short period of time.

The needle-point canvas is a sized cotton material which, when lightly wetted or steamed is readily shaped so that all of the openings are squared and in line. Proper orientation may require some re-stretching of the canvas while moist and allowing the canvas to dry in the stretched condition. Once dried the canvas retains its shape and orientation throughout the printing process.

Instead of a hinged printer as illustrated, the printing plate holder 66 can be mounted on a track over the platen 60 and oscillate to and from a position in contact with the top of a paint roller, the bottom of which is in contact with a supply of paint, and to a position over the platen 60 where it is forced down into printing contact with the canvas. A platen with the grid support and canvas thereon can be on each end of the track so that the printing plate holder oscillates from a printing position on one side over into contact with the paint supplying roller to the other side into a printing position with the second platen. The squares of needle-point canvas can be placed by hand on the platens on one side as the other side is being printed. Or the canvas can be brought to each platen as a continuous strip by mechanical means capable of intermittent operation so that the canvas strip stops and is oriented over the grod support in successive segments on each side of the machine.

The apparatus of FIG. 15 can be arranged in an upside down position in which even the chamber 132 can be omitted and the paint drums 140 replaced with rollers which have a cloth or textured surface with their bottom surfaces in contact with a supply of paint. This arrangement takes advantage of the ease with which the paint can be picked up by the printing roller pads from the top side of the paint roller. Any excess paint returns to the roller and paint supply.

Hand painting of a piece of 10×10 canvas with six colors requires at least one-half hour under ideal conditions. The method of this invention requires less than a minute, even using the hand-operated printer of FIG. 9, for such an operation, and an automatic machine could print such canvases in much less time per unit. As little as three seconds would be required for each color or with a six color print a total of 18 seconds for each design. This would be about one hundred times faster than hand painting and the end product is greatly improved. Accordingly, the time consuming, inaccurate and tedious hand-painting process for preparing needle-point pieces is made obsolete by this invention. The main difficulty in hand painting is that the worker must lay the canvas over the design and it is very difficult to see the design through the canvas as paint is applied. Furthermore, during hand painting the paint application is not uniform, paint often fills the holes in the canvas and paint eventually reaches the design making the pattern less precise. It is particularly difficult in hand painting to obtain a sharp edge where the design demarcation subtends across an opening in the canvas since the paint flows laterally in these spaces. The same difficulties occur with the use of a stencil or a flat surface printer, the latter method fails entirely to cover the strands completely since only the uppermost portions of the strands contact the printer. The supporting grid of this invention in combination with the soft porous paint applicator or shoe, eliminates these difficulties.

A number of foamed or expanded plastics can be used to form the printing surfaces 46 in the printing shoes 136 used in accordance with this invention. Among them are ethylene copolymers, polyethylene, polypropylene, polyurethanes and polyvinyl chloride. Preferably the foams are of the open cell type, flexible and non-rigid and accordingly low-density-polyethylene is the preferred material.

The grid supports 54 and 128, whether in sheet or belt form, can be composed of metals or plastics, the latter being preferred because of being lightweight, strong and inexpensive. For this purpose, styrene, polyvinyl-chloride, polyesters, nylon, acrylics, acetates, alkyds, allyes, epoxies, chlorinated polyethers and fluoroplastics can be used.

All of the materials of construction used must be resistant to solvents that may be present in the paint compositions used. Preferably, the paints used are quick drying readily compounded into a variety of color shades as are necessary for needle-point designs where color harmony and esthetic qualities are often paramount. The apparatus of this invention can be produced in a simple kit form for use by people who want to manufacture needle-point in their homes or on a limited scale.

An important aspect of the invention is that the printing shoes be oriented so that they come into printing contact with the cross-over points of the strands 14 and 16 of the canvas and the demarcation lines 30 (FIG. 2) between colors come between the strands and not across the cross-over points. For continental or similar stitches there are generally two threads in each hole of the canvas. The demarcation between the design colors are generally on a stitch between the cross stitches. Where a hole in the canvas is bordered by one color during stitching, two threads of that color will pass therethrough, one in and one out. Where a hole has a line of color demarcation, it will contain a thread of each color so represented.

Referring to FIG. 6, the rigid base or shoe portion 22a is shown to have its edges in the plane of the square cut edge of the foamed plastic part 46. These edges need not be in the same plane and the shoe portion 22a can be bevelled inwardly or outwardly. It is important that the rigid shoe portions of all of the printers have sufficient depth in relation to the depth of the expanded plastic printer 46 so that there is adequate spacing from the canvas and no tendency for the paint to ooze at the edges onto the canvas. The plate 60 of the apparatus 59 shown in FIGS. 9, 10 and 11 can be perforated to provide means to remove excess paint as desired. The plate 60 can be placed over a receptacle with means for drawing air therethrough to facilitate the removal of excess paint.

Although parts of the apparatus are shown diagrammatically and certain of the mechanical means to rotate, orient and oscillate the parts are not disclosed in detail, it is considered that one skilled in this art is presented with sufficient directions by which the invention using the supporting grid with either a hinged, oscillating or rotary printer can carry out the invention. Accordingly, the details of such mechanisms need not be further explained, same being old in the art and any number of means can be used to perform the process or manipulate the printer once the concept of the supporting grid with or without means to withdraw any excess paint is understood.

What is claimed is:

1. A printer for use in printing a multi-colored coded design on the outer surfaces of one side of the spaced interwoven bi-axial strands of a piece of presteamed and softened needle point canvas comprising:

a support and orienting plate;

spaced upright projections on one side of said support and orienting plate corresponding to the spaces between the strands of said canvas whereby placement of said canvas thereon in softened condition bi-axially orients said strands;

a support grid having a lattice of ribs corresponding to the bi-axial strands of said canvas and adapted to be placed on said projections of said support plate to orient said lattice of ribs with said strands of said canvas and provide support for the individual strands of said canvas along their two axes when placed thereon and removed from said orienting plate;

a printing plate;

printing means adapted to be affixed to said printing plate;

said printing means having a resilient porous paint carrier surface for one of said colors and shaped in reverse of the desired outline of said design;

means to apply paint of one of said colors to said paint carrier surface and means to orient said printing plate upon said canvas whereby said paint carrier surface is brought into contact on said side with the outer portions of the strands of said canvas piece at a predetermined location thereon while supported on said support grid.

2. A needle point canvas printer in accordance with claim 1 in which:

said printing plate is provided with a reverse outline of said multi-colored coded design;

said printing means for each of the colors of the multi-colored coded design are shaped to conform with the corresponding parts of said reverse outline; and means are provided to attach each of said printing means upon said printing plate in conformity with the outlined portion thereof.

3. A needle point canvas printer in accordance with claim 1 in which:

means are provided to apply a partial vacuum under said support grid.

4. A needle point canvas printer in accordance with claim 1 in which:

said support grid comprises a continuous grid belt;

said printing plate comprises a cylindrical member rotatably supported on an axis transverse said continuous grid belt;

said printing means comprise at least one radially extending shoe carried by said cylindrical member;

means to convey a strip of pre-steamed canvas over and in oriented justaposition upon said continuous grid belt;

means to rotate said cylindrical member and said continuous grid belt in synchronism whereby to carry said canvas therebetween and print successive portions of said design upon said canvas; and means to supply a paint material to said shoe during each successive contact with said canvas.

5. A needle point canvas printer in accordance with claim 8 in which:

said continuous grid belt is carried by at least a pair of axially spaced rollers; and said rollers having a plurality of radially extending pins on the peripheral surfaces;

said pins being spaced to engage within corresponding holes in said grid belt and said canvas to maintain the grid belt under the strands of said canvas.

6. A needle-point canvas printer in accordance with claim 4 in which:

said continuous grid belt is carried by at least a pair of axially spaced rollers;

said grid belt having a plurality of outwardly extending pins along said surface;

said pins being spaced to engage within corresponding holes in said canvas to maintain the grid belt under the strands of said canvas.

7. A needle-point canvas printer in accordance with claim 4 in which:

means are provided to withdraw any excess paint from said canvas after contact with said printing means.

8. A needle-point canvas printer in accordance with claim 4 in which:

means are provided to withdraw any excess paint from said continuous grid belt after contact with said painted canvas.

9. A needle-point printer in accordance with claim 4 in which:

said cylindrical member supports a reservoir of paint in communication with said radially extending shoe.

10. A needle-point printer in accordance with claim 4 in which:

said cylindrical member supports a plurality of radially extending shoes.

11. A needle-point printer in accordance with claim 10 in which:

each of said shoes is provided with an individual reservoir of paint.

12. A needle-point canvas printer in accordance with claim 10 in which:

said printing means comprises a series of axially spaced cylindrical members;

each of said cylindrical members carrying a group of said shoes representing a portion of a desired design;

said groups extending axially along said cylindrical member and being spaced from adjacent groups of said resilient shoes;

whereby the imprints of the shoes of one cylinder are spaced longitudinally of said canvas and the imprints of the successive shoes on the next cylinder are placed in the unpainted spaces therebetween.

13. A needle-point printer in accordance with claim 4 in which:

said shoe has a preformed printing surface conforming to the interwoven bi-axial strands for said canvas.

14. A device for printing designs on a piece of needle point canvas having interwoven bi-axial crossed strands comprising:

a plurality of individual resilient printing shoes;

an elongated paint reservoir to convey paint to said printing shoes affixed to and communicating with each printing shoe;

means to hold said reservoirs in juxtaposition with each other in groups;

means supporting said groups of printing shoes whereby to print one side of said piece of needle point canvas with a design;

means to reciprocate said holding means and move said printing shoes sequentially into printing contact with said canvas;

a support grid positionable against the other side of said piece of canvas having crossed strands which conform to the crossed strands of said canvas piece whereby each strand is supported against said resilient shoes; and means to advance said canvas and said support grid in unison in relation to said printing shoes.

15. A device for printing needle point design on presteamed canvas pieces having crossed interwoven bi-axial strands comprising:

a flat platen having upright orienting pins on one surface adapted to engage between said bi-axial strands of said canvas piece;

a print carrier hinged to said platen along one edge;

a support grid having crossed ribs conforming to the crossed strands of said canvas piece whereby said grid is adapted to support said canvas piece in squared relationship on the orienting pins of said platen;

at least one printing shoe having a resilient paint carrying face, said face having an outline the reverse of the desired design; and means to hold said printing shoe upon said print carrier.

16. A needle-point canvas printer for use with needle point canvas peices having crossed interwoven bi-axial strands comprising:

a support plate;

spaced upright projections on one side of said support plate corresponding to the spaces between the bi-axial strands of said canvas;

a support grid having a lattice of ribs corresponding to the bi-axial strands of said canvas and adapted to be placed on said projections of said support plate and provide support for the individual strands of said canvas along their two axes when placed thereon;

a printing plate;

means to oscillate said printing plate to and from said support grid;

printing means adapted to be affixed to said printing plate;

said printing means having a resilient porous paint carrier surface shaped in reverse of the desired outline of said design;

means to apply paint to said paint carrier surface and means to orient said printing plate upon said support plate whereby said paint carrier surface is brought into contact with the outer portions of the strands of said canvas while supported on said support grid.

* * * * *